US005167462A

United States Patent [19]

Lucas

[11] Patent Number: 5,167,462

[45] Date of Patent: Dec. 1, 1992

[54] APPLICATOR FOR SOLIDIFIED PRODUCTS

[75] Inventor: Marthe Lucas, La Grande Motte, France

[73] Assignee: Societe De Conseils Et D'Etudes Des Emballages (SCEE), S.A., Dammartin en Goele, France

[21] Appl. No.: 850,949

[22] Filed: Mar. 13, 1992

[30] Foreign Application Priority Data

Mar. 15, 1991 [FR] France ..... 91 03205

[51] Int. Cl.[5] ..... A45D 40/02; A45D 40/16

[52] U.S. Cl. ..... 401/82; 401/87; 401/98

[58] Field of Search ..... 401/82, 83, 84, 87, 401/98

[56] References Cited

U.S. PATENT DOCUMENTS 2,415,306 10/1944 Rich .
3,443,874 5/1969 Pelli et al. ..... 401/82
3,912,403 10/1975 Gjerloff .
4,139,311 2/1979 Lorscheidt .
4,815,485 3/1989 Morel .
4,917,133 4/1990 Morel ..... 401/98 XR

FOREIGN PATENT DOCUMENTS 0249540 12/1987 European Pat. Off. .
0383670 8/1990 European Pat. Off. .
2188980 1/1974 France .
2350278 12/1977 France .

*Primary Examiner*—Steven A. Bratlie
*Attorney, Agent, or Firm*—Sandler, Greenblum, & Bernstein

[57] ABSTRACT

Applicator for solidified products is provided with a hollow body and a removable cap forming a case adapted to house the product. A driving mechanism is provided for to and fro translation of the product in order to extract and retract it. A mechanism comprising a support base for the product is movably mounted in the body and is provided with an extension that extends opposite to the product and is adapted to be engaged with an element affixed to a cursor by a connection tab that passes through the body. The cursor is arranged in a movable manner outside the body in such a way that activation of the cursor brings about an equivalent translational movement of the base and thus of the product.

24 Claims, 2 Drawing Sheets

FIG. 1
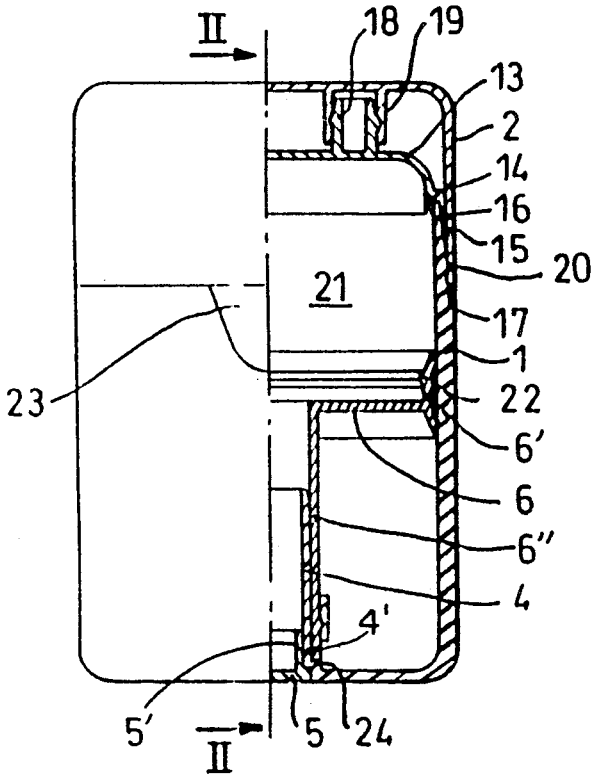
FIG. 3
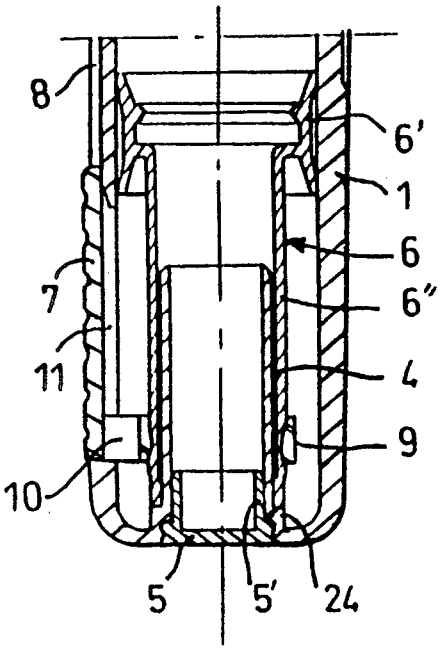
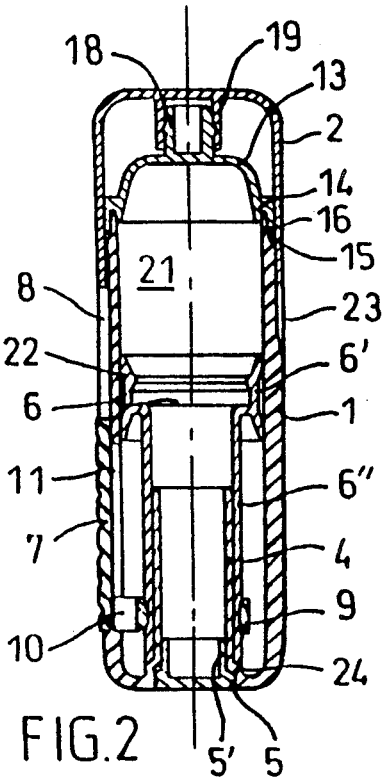
FIG. 2
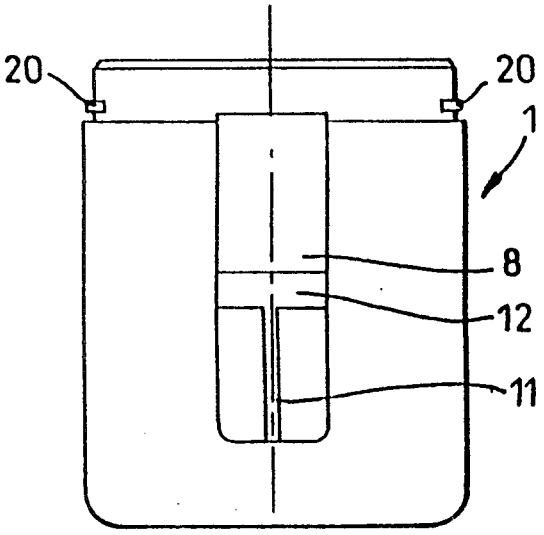
FIG. 4

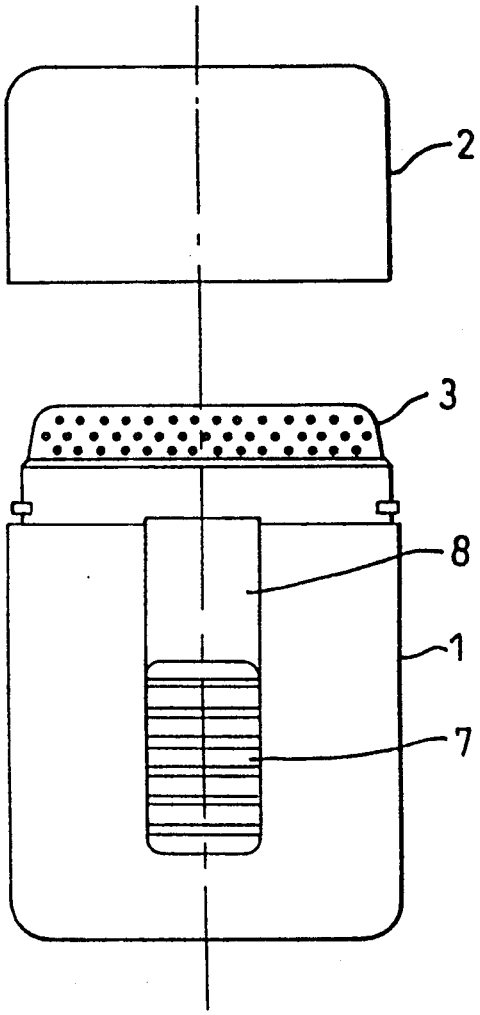
FIG.5
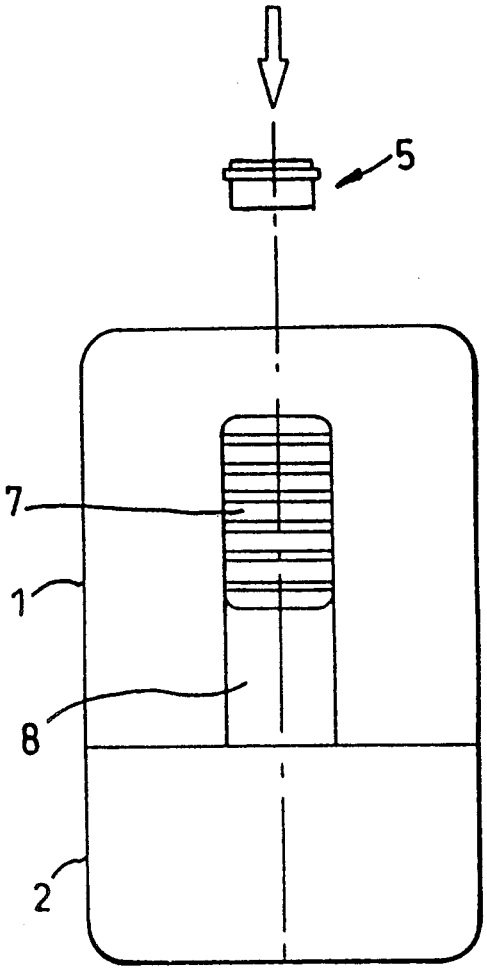
FIG.6
FIG.7
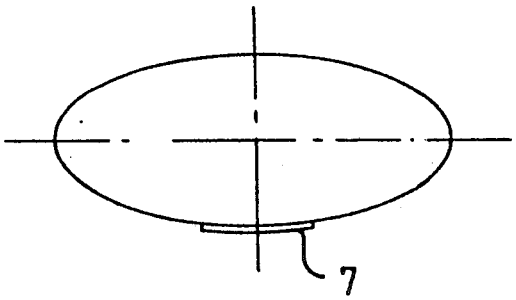

APPLICATOR FOR SOLIDIFIED PRODUCTS

BACKGROUND OF THE INVENTION

1. Field of the Invention

The present invention is related to an applicator with a cursor for solidified products, such as products that become solid at room temperature.

2. Discussion of Background Material

An applicator for solidified products generally comprises a hollow body and a removable cap that forms a case adapted to house the product, and a driving mechanism for the to and fro translation required to extract and retract the product. Such applicators are used for cosmetic products, such as deodorants and lipsticks, but can also be used for pharmaceutical products, household goods such as wax, and even other commonly used items, such as glue, or any other similar product which can be incorporated in such an applicator.

All of these solidified products, which generally have a waxy consistency, are applied by rubbing. They are usually presented in the shape of sticks or loaves, whereby the popular denomination "stick" is used.

Applicators of the known type are clumsy to use because when the cap is removed, the user must hold the body and manipulate the mechanism, generally a screw mechanism, in order to push up the product. Such type of manipulation renders it impossible to operate this type of applicator with only one hand after removal of the cap.

Moreover, filling the product before solidification is often difficult.

SUMMARY OF THE INVENTION

It is an object of the present invention to overcome the disadvantages associated with conventional product applicators by providing a simple device, which is easy to manufacture and practical to use.

The applicator according to the present invention is remarkable in that the mechanism comprises a support base for the product, mounted movably in the body and provided with an extension which extends opposite the product. The extension is adapted to engage with a guide element, affixed to a cursor by a connection tab that passes through the body, with the cursor being arranged in a movable manner outside the body in such a way that activation of the cursor results in an equivalent translational movement of the base, and thus of the product.

It is also an object of the present invention to provide an applicator that is particularly easy to use and can be operated with only one hand.

According to one embodiment, the guide element which is affixed to the cursor is a ring, adapted to be fixed about the extension of the base.

Preferably, the body has a longitudinal slot adapted to guide and enable the connection tab to pass through the body. The connection tab is provided between the guide element and the cursor, and the slot comprises a transverse enlargement, forming an opening in the body for the passage of the guide element during assembly of the component elements of the applicator. Additionally, the wall of the body can be provided with a groove in which the cursor is displaced.

Advantageously, the extension of the base is tubular and can be introduced over an internal chimney that is arranged on the base of the body from where it projects. In this case, for example, the internal chimney of the body is tubular and exits via an opening of the body towards the outside, whereas the tubular extension of the base exits in it, and a stopper is provided to block the opening towards the outside in such a way that it is possible to fill the applicator with the product via the opening, the product being in the liquid or semi-liquid state before solidification.

Therefore, the present invention offers a particularly advantageous mode of filling. Preferably, in this case, the cap has an internal portion that forms a sealing joint in cooperation with a corresponding part of the body when the cap is positioned on the body.

Therefore, it is a further object of the invention to provide a method for filling an applicator for solidified products, comprising pouring a liquid or waxy product into an applicator comprising a hollow body and a removable cap forming a case capable of housing the solidified product; a driving mechanism for to and fro translation that enables the solidified product to be extracted and retracted, the driving mechanism comprising a support base for the solidified product movably mounted in the hollow body, an extension that extends opposite to the solidified product and engageable with an element affixed to a cursor by a connection tab that passes through the body, the cursor being constructed and arranged in a movable manner outside the body so that movement of the cursor results in an equivalent translational movement of the base and of the solidified product; and an internal chimney upwardly extending from a base portion of the body, and the extension comprises a tubular shape positioned over the internal chimney, and the internal chimney comprises a tubular shape opening to the exterior of the body by an opening; and permitting the liquid or waxy product to solidify.

Further, a stopper can be inserted into the opening to seal the applicator.

Also, for example, the base for the product has a peripheral portion forming a piston that slides in a substantially sealed manner in the body.

According to a preferred embodiment, all the component elements are fixed to one another by the cooperation of conjugated grooves and ribs, and such structure is especially utilized to affix the guide element with the extension of the base, the blocking stopper with the body, and the joint with the cap.

BRIEF DESCRIPTION OF THE DRAWINGS

The present invention will be better understood and other characteristics will become more apparent upon reading the description provided hereinafter, and with reference to the annexed drawings which illustrate non-limiting embodiments, in which:

FIG. 1 is a semi-sectional elevational view of an applicator according to the invention.

FIG. 2 is a section along line II—II of FIG. 1.

FIG. 3 represents the lower portion of FIG. 2 at a larger scale.

FIG. 4 shows the empty body without a cursor from the side opposite to that shown in FIG. 1.

FIG. 5 shows the applicator ready to be used.

FIG. 6 shows the applicator in an upturned position in order to be filled.

FIG. 7 is an elevational view of FIG. 5.

DETAILED DESCRIPTION OF THE PREFERRED EMBODIMENTS

The embodiments represented in the drawings provide non-limiting illustrations of the present invention wherein the applicator is shown as comprising a hollow body 1 having a substantially oval cross-section (FIG. 7) and a removable cap 2 (FIGS. 1, 2, 5 and 6).

Body 1 and cap 2 form a case adapted to house a stick or loaf of a solidified product 3 (FIG. 5).

The body 1 is provided with an internal central chimney that projects from its base (FIGS. 1–3).

Chimney 4 is a cylindrical tube which is blocked towards the outside by a stopper 5 (FIGS. 1, 2, 3 and 6) provided with a skirt 5' adapted to be introduced into the chimney.

The stick of product 3 shown in FIG. 5 is maintained in a base 6 (FIGS. 1–3). The base 6 has a peripheral portion with double lips forming a piston 6' and a tubular extension 6'' directed towards the base of body 1. The extension is open from one end to the other, so that it is capable of receiving chimney 4 that is introduced into the extension.

As is shown in FIGS. 2, 3, 5 and 6, an external serrated cursor 7 of a substantially rectangular shape is mounted movably outside body 1 in a groove 8 with corresponding dimensions, arranged in the wall of the body 1.

Cursor 7 is affixed to ring 9 that is adapted to be fixed about and towards the end of extension 6'' of base 6 (FIGS. 1–3), with the ring 9 being linked to cursor 7 by a connection tab 10 (FIGS. 2 and 3) that passes through a longitudinal slot 11 (FIGS. 2, 3, 4) arranged in groove 8 of body 1.

Slot 11 broadens in its upper portion by a transverse window 12 (FIG. 4) adapted, as will be explained hereafter, for the passage of ring 9, during assembly of the component elements of the applicator. The opening 12 remains masked by the cursor 7, whatever the position of the cursor. Additionally, the piston portion 6' of base 6 when it is in the lowered position as represented in all the drawings, remains above the opening 12.

As is especially shown in FIGS. 1 and 2, and will be further explained below, cap 2 is provided with an added joint 13 of a concave shape to form a mold for the product. Joint 13 is provided with two peripheral lips 14, 15 (FIGS. 1 and 2) that form therebetween a groove adapted to receive a narrowed end 16 of the body 1 by stopping it in a sealed manner. Body 1 is moreover provided with a shoulder 17 adapted to stop cap 2.

As can be see from the above, the illustrated and described embodiment comprises only six elements. These elements; namely, body 1, cap 2 and its added joint 13, base 6, cursor 7 (provided and affixed to ring 9) and stopper 5, can be molded, for example, by injection molding.

Moreover, all of these elements are particularly easy to assemble, and according to a preferred embodiment, the assembly does not necessitate the use of any other means because these elements can all be fixed together by elasticity by the cooperation of conjugated ribs or rings and grooves or necks.

This is how, for example, as is represented in the drawings, joint 13 may be fixed in cap 2 by conjugated nesting sleeves with ribs and grooves, such as, respectively, sleeves 18, 19 (FIGS. 1 and 2), and this is how ring 9 can be fixed on extension 6'' (after introduction of the ring via opening 12 of the body and introduction of base 6 by the open upper portion of the body 1). Similarly, stopper 5 can be fixed in the base of body 1 by cooperation of ribs and necks arranged on the corresponding elements. In this manner, after assembly, base 6 and ring 9 are imprisoned by body 1.

In a similar manner, cap 2 can be removably fixed by elasticity, by short ribs 20 of the body (FIGS. 1 and 4) and corresponding necks of the cap (other than the maintenance already obtained by joint 13).

This type of simple assembly, moreover, enables the elements to be sealed from one another to some extent. To this end, for example, an internal rib 4' can be provided on extension 6'' of the base which then rubs on the external wall of the chimney 4.

In light of the assured seal between joint 13 and body 1, between piston 6' and body 1, between extension 6'' and chimney 4, between stopper 5, body 1 and chimney 4, it is easy to understand the filling method represented in FIG. 6. Once the applicator has been overturned (FIG. 6), all that need be done to obtain an applicator having the product therein is to fill, via chimney 4 and extension 6'', volume 21 (FIGS. 1 and 2) formed between base 6 and the internal lateral wall of body 1 and joint 13 with a product, in a more or less viscous state, and thereafter block chimney 4 with stopper 5, in order to obtain, after cooling, the stick or loaf of product (such as product 3 shown in FIG. 5), which remains anchored in piston 6' of the base, especially, for example, by an internal rib 22 arranged in the piston 6' (FIGS. 1 and 2).

After obtaining the applicator with the product therein, it is simple to use. One need only remove cap 2, which is facilitated by groove 8 and possibly also by a small recess such as 23 (FIGS. 1 and 2) arranged on the outer surface of the body 1, whereby product 3 would protrude from the body.

In order to push up the product further, especially to compensate for its use over time, cursor 7 is activated upwardly (with respect to FIGS. 1 and 5). Tab 10, which is slidable in slot 11 causes ring 9 to drive product 3 by means of base 6 whose extension 6'' slides on chimney 4. The extreme upward position of base 6 is obtained when tab 10 comes into abutment at the top of opening 12.

It is understood that one can, of course, retract the product by reverse movement of the cursor 7. In such a case, the extreme position in this direction of extension 6'' is, for example, determined by a shoulder 24, provided at the base of the chimney 4 (FIGS. 1–3).

This application is related to French Application No. 9103205, filed Mar. 15, 1991, whose priority is claimed, the disclosure and drawings of which are incorporated by reference thereto in their entirety.

Numerous variations may obviously be envisioned without departing from the object of the invention, especially with respect to assembly means, the positioning and the shape of the cursor, as well as the general shape of the body that can have any other type of section, such as circular or polygonal.

What is claimed is:

1. Applicator for solidified products, comprising a hollow body and a removable cap forming a case capable of molding a solidified product; and a driving mechanism for to and fro translation that enables the solidified product to be extracted and retracted, said driving mechanism comprising a support base for the solidified product movably mounted in said body, an unobstructed tubular extension that extends opposite to the solidified product and engageable with an element affixed to a cursor by a connection tab that passes through said body, said cursor being constructed and arranged in a movable manner outside said body so that movement of said cursor results in an equivalent translational movement of said base and of the solidified product.

2. Applicator as defined by claim 1, wherein said element affixed to said cursor comprises a ring adapted to be affixed about said extension of said base.

3. Applicator as defined by claim 1, wherein said body includes a longitudinal slot for guiding passage of said connection tab.

4. Applicator as defined by claim 3, wherein said longitudinal slot comprises a transverse enlargement forming an opening in said body for passage of said element during assembly of component elements of the applicator.

5. Applicator as defined by claim 2, wherein said body includes a longitudinal slot for guiding passage of said connection tab.

6. Applicator as defined by claim 5, wherein said longitudinal slot comprises a transverse enlargement forming an opening in said body for passage of said element during assembly of component elements of the applicator.

7. Applicator as defined by claim 1, wherein said body includes a wall having a groove in which said cursor is movably mounted.

8. Applicator as defined by claim 2, wherein said body includes a wall having a groove in which said cursor is movably mounted.

9. Applicator as defined by claim 3, wherein said body includes a wall having a groove in which said cursor is movably mounted.

10. Applicator as defined by claim 1, further including an internal chimney upwardly extending from a base portion of said body, and said extension comprises a first tubular-shaped element positioned over said internal chimney.

11. Applicator as defined by claim 10, wherein said internal chimney comprises a second tubular-shaped element opening to the exterior of the body by an opening.

12. Applicator according to claim 11, further including a stopper for blocking said opening towards the outside so that the applicator can be filled via said opening with the product in a liquid or viscous state before solidification.

13. Applicator as defined by claim 12, wherein said stopper and said opening are affixed to each other by cooperation of conjugated ribs and grooves.

14. Applicator as defined by claim 1, wherein said cap has an internal portion forming a sealing joint by cooperating with a corresponding part of said body when said cap is positioned on said body.

15. Applicator as defined by claim 14, wherein said cap and said body are affixed to each other by cooperation of conjugated ribs and grooves.

16. Applicator as defined by claim 1, wherein said support base for the solidified product comprises a peripheral portion forming a piston that slides in a substantially sealed manner in said body.

17. Applicator as defined by claim 16, wherein said body includes a wall having a groove in which said cursor is movably mounted.

18. Applicator as defined by claim 17, wherein said body includes a longitudinal slot for guiding passage of said connection tab.

19. Applicator as defined by claim 18, wherein said longitudinal slot comprises a transverse enlargement forming an opening in said body for passage of said element during assembly of component elements of the applicator.

20. Applicator as defined by claim 1, wherein component elements are fixed to one another by cooperation of conjugated ribs and grooves.

21. Applicator as defined by claim 20, wherein all component elements are fixed to one another by cooperation of conjugated ribs and grooves.

22. Applicator as defined by claim 21, wherein said element and said extension are affixed to each other by cooperation of conjugated ribs and grooves.

23. Method for filling an applicator for solidified products, comprising:

pouring a liquid or waxy product into an applicator comprising:

a hollow body and a removable cap forming a case capable of housing a solidified product;

a driving mechanism for to and fro translation that enables the solidified product to be extracted and retracted, said driving mechanism comprising a support base for the solidified product movably mounted in said body, an extension that extends opposite to the solidified product and engageable with an element affixed to a cursor by a connection tab that passes through said body, said cursor being constructed and arranged in a movable manner outside said body so that movement of said cursor results in an equivalent translational movement of said base and of the solidified product; and an internal chimney upwardly extending from a base portion of said body, and said extension comprises a first tubular-shaped element positioned over said internal chimney, and said internal chimney comprises a second tubular-shaped element opening to the exterior of the body by an opening; and permitting the liquid or waxy product to solidify.

24. The method as defined in claim 23, further including inserting a stopper in the opening.

* * * * *